US010595611B2

(12) United States Patent
Berkley et al.

(10) Patent No.: US 10,595,611 B2
(45) Date of Patent: Mar. 24, 2020

(54) COSMETIC WALLET COMPACT

(71) Applicants: Aymie Berkley, Scottsdale, AZ (US); Lynn Goodman, Hillsborough, CA (US)

(72) Inventors: Aymie Berkley, Scottsdale, AZ (US); Lynn Goodman, Hillsborough, CA (US)

( * ) Notice: Subject to any disclaimer, the term of this patent is extended or adjusted under 35 U.S.C. 154(b) by 44 days.

(21) Appl. No.: 15/619,224

(22) Filed: Jun. 9, 2017

(65) Prior Publication Data

US 2017/0354229 A1 Dec. 14, 2017

Related U.S. Application Data

(60) Provisional application No. 62/350,163, filed on Jun. 14, 2016.

(51) Int. Cl.
*A45D 33/26* (2006.01)
*A45C 1/06* (2006.01)
(Continued)

(52) U.S. Cl.
CPC ..... *A45D 33/26* (2013.01); *A45C 1/06* (2013.01); *A45C 13/005* (2013.01); *A45C 13/02* (2013.01);
(Continued)

(58) Field of Classification Search
CPC .... A45D 33/26; A45D 33/008; A45D 33/006; A45D 40/24; A45C 2001/065;
(Continued)

(56) References Cited

U.S. PATENT DOCUMENTS 4,589,430 A * 5/1986 Sussman ..... A45D 40/22 132/218
5,718,329 A * 2/1998 Ippolito ..... A45C 11/182 150/147
(Continued)

FOREIGN PATENT DOCUMENTS

KR 20090014092 2/2009
KR 10-2013-0127278 * 11/2013 ..... A45C 11/00
(Continued)

OTHER PUBLICATIONS

English Translation of KR 10-2013-0127278 (Year: 2013).*

*Primary Examiner* — Steven A. Reynolds
(74) *Attorney, Agent, or Firm* — Stern & Schurin LLP

(57) ABSTRACT

A cosmetic wallet compact including a housing having a first casing, a second casing and attachment means, such as hook and loop fastener strips, to attach the cosmetic wallet compact to a handheld device. First casing is adapted and sized to hold and retain credit card(s), identification card(s) and folded bill(s) in an interior cavity. First casing incorporates a receiving slot and a window through which its contents may be seen and physically manipulated. At the window, a retaining press is provided which keeps cards in place and from unintentionally exiting the receiving slot after being inserted. An ejection guide aperture is further provided to selectively guide contents out of the receiving slot. Second casing has an interior which defines a palette of color cosmetics and a mirror panel.

10 Claims, 5 Drawing Sheets

(51) Int. Cl.

| | |
|---|---|
| ***A45C 13/10*** | (2006.01) |
| ***A45C 13/02*** | (2006.01) |
| ***A45C 13/00*** | (2006.01) |
| ***A45D 40/24*** | (2006.01) |
| ***A45D 40/22*** | (2006.01) |
| ***A45D 42/02*** | (2006.01) |

(52) U.S. Cl.

CPC ..... *A45C 13/10* (2013.01); *A45D 40/222* (2013.01); *A45D 40/24* (2013.01); *A45D 42/02* (2013.01); *A45C 2001/065* (2013.01); *A45C 2001/067* (2013.01); *A45C 2013/1015* (2013.01)

(58) Field of Classification Search

CPC ..... A45C 2001/083; A45C 2001/086; A45C 11/182; A45C 1/06; A45C 13/02; A45C 2001/067

USPC ..... 206/581, 38, 320; 150/147, 148, 149, 150/136

See application file for complete search history.

(56) References Cited

U.S. PATENT DOCUMENTS

| | | | | |
|---|---|---|---|---|
| 5,938,010 | A * | 8/1999 | Osterbye | A45C 11/182 206/38 |
| 6,026,873 | A * | 2/2000 | Van Geer | A45C 11/182 150/147 |
| 6,311,077 | B1 | 10/2001 | Bien | |
| 7,334,616 | B2 * | 2/2008 | Kaminski | A45C 11/182 150/147 |
| 7,431,161 | B2 * | 10/2008 | Carlino | B65D 69/00 206/581 |
| 8,418,852 | B2 | 4/2013 | Ziemba | |
| 8,602,039 | B1 * | 12/2013 | Gindi | A45D 33/008 132/294 |
| 8,833,379 | B1 * | 9/2014 | Kaplan | A45D 33/26 132/287 |
| 8,978,886 | B2 * | 3/2015 | Ziemba | A45C 1/04 206/320 |
| 2006/0027481 | A1 * | 2/2006 | Gelardi | A45D 33/008 206/581 |
| 2009/0166247 | A1 | 7/2009 | Gindi | |
| 2011/0077061 | A1 | 3/2011 | Danze et al. | |
| 2012/0264491 | A1 | 10/2012 | Singhal | |
| 2013/0298926 | A1 | 11/2013 | Smeragliuolo | |
| 2014/0144796 | A1 * | 5/2014 | Ziemba | A45C 1/04 206/235 |
| 2014/0251368 | A1 * | 9/2014 | Lawson | A45C 11/00 132/287 |
| 2016/0206062 | A1 * | 7/2016 | Marvin | A45C 11/00 |
| 2018/0344004 | A1 * | 12/2018 | Kim | A45C 11/00 |

FOREIGN PATENT DOCUMENTS

| | | |
|---|---|---|
| WO | 2015041725 | 9/1940 |
| WO | 2014059301 | 4/2014 |
| WO | 2015006284 | 1/2015 |

* cited by examiner

COSMETIC WALLET COMPACT

RELATED APPLICATION

This application claims priority to and the benefit of U.S. provisional application, Application Ser. No. 62/350,163, filed on Jun. 14, 2016, which is incorporated herein by reference.

FIELD OF THE INVENTION

The present application relates generally to the field of portable containers. More specifically, the invention involves an improved cosmetic compact that selectively attaches and separates from a smartphone. Even more particularly, the invention relates to a cosmetic wallet compact that accommodates credit cards, identification cards and cosmetics for effective and easy access by users.

BACKGROUND OF THE INVENTION

As individuals endeavor to be become more mobile, many devices have been created to support these efforts. Over the years, several compartmentalized accessories have been created, which aim to combine a compact carrying case with a smartphone or other handheld mobile device. For example, U.S. Pat. No. 8,418,852 discloses a compartmentalized protective case which houses a portable electronic device and personal care items, such as cosmetics and health care products. The device also includes a second compartment with a restraining system to hold identification cards, currency, bank cards, and/or keys. Other references, such as U.S. Published Application 201100777061, KR20090014092 and WO2014059301, likewise describe the union of handheld devices with protective cases and compacts that retain cosmetics, credit cards, business cards and other items.

Notwithstanding the proposed benefits of these and other accessories aimed at promoting mobility by reducing or eliminating the need for larger carrying instruments (e.g., pocketbook, handbag, purse, backpack, briefcase, wallet etc.), these devices are often awkward, clunky and unwieldly, often defeating the purpose of utilizing them in the first instance. In addition, the combined thickness or height of these devices with those of the handheld device to which they are attached, often render the combined unit extremely difficult to carry in a pocket or handle manually. Moreover, based on their design, it is often difficult to remove credit cards, identification cards, and other contents from prior art protective cases and compacts without struggle.

SUMMARY OF THE INVENTION

In view of the deficiencies and drawbacks in the prior art, it is a primary object of the present invention to provide a cosmetic wallet compact that selectively attaches to and detaches from the back surface of a handheld device, such as a smartphone.

Another object of the present invention is to provide a cosmetic wallet compact with a first casing into which a user may easily insert and retain credit cards, identification cards and cash, and a second casing to accommodate color cosmetics and a mirror panel.

Yet another object of the present invention is to provide a cosmetic wallet compact with a dual function window that defines a retaining press and an ejection aperture through which a user may selectively guide credit cards, identification cards and similar items.

Another object of the present invention is to provide a cosmetic wallet compact with curved contours that help avoid separation of the compact from the handheld device to which it is attached when tucked into a pocket.

A further object of the present invention is to provide a cosmetic wallet compact that comes pre-filled with an assortment of makeup products.

Additional objectives will be apparent from the description of the invention that follows.

In summary, there is provided in a preferred embodiment of the present invention a cosmetic wallet compact comprising a housing that is adapted to be attached to the back surface of a handheld device using mating strips of hook and loop fasteners (e.g., Velcro). The housing comprises a first casing adapted and sized to hold and retain cards (e.g., credit cards, identification cards, business cards) and folded paper bills, and a second casing with cosmetics and a mirror panel. The first casing has an interior cavity and incorporates a receiving slot and a dual function window through which contents of the first casing may be seen and physically manipulated by a user. The window defines a retaining press which keeps cards and folded bills in place and from unintentionally exiting the receiving slot after being inserted. The window also defines an ejection guide aperture large enough to accommodate a finger of a user through which the user may selectively guide the contents from the first casing out of the receiving slot when needed. The second casing has an interior which incorporates a palette of color cosmetics and a mirror panel, preferably comprising a mirrored surface. In a preferred embodiment, the second casing shares a wall with the first casing and the two casings are hingedly attached to one another and fastened closed via a conventional snap or clip fastener.

BRIEF DESCRIPTION OF THE DRAWINGS

The advantages and features of the present disclosure will be appreciated and understood by those skilled in the art from the following detailed description and drawings of which

DETAILED DESCRIPTION OF THE INVENTION

Figure 1:
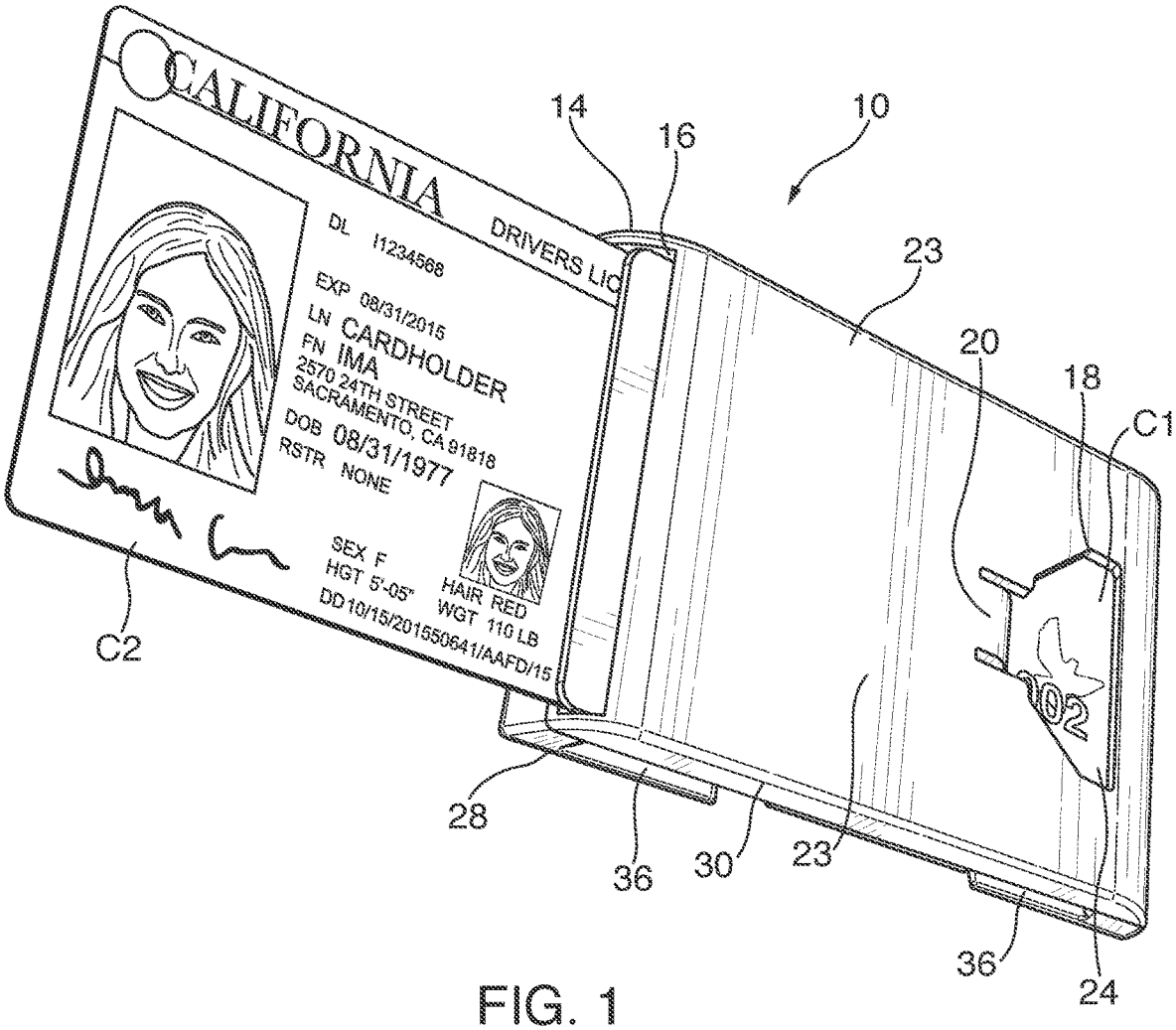
FIG. 1 depicts a first embodiment of the cosmetic wallet compact of the present invention in a closed position.
Figure 2:
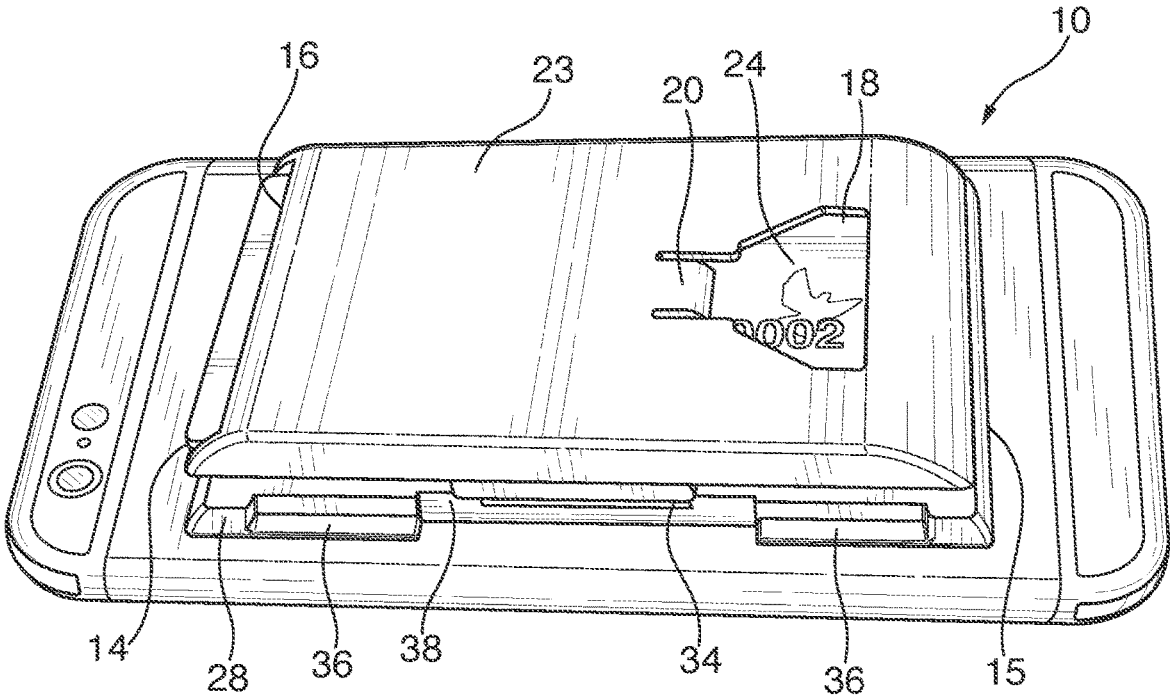
FIG. 2 depicts the cosmetic wallet compact attached to the back surface of a handheld device.

With reference to FIG. 1 through FIG. 7, there is shown a preferred embodiment of the cosmetic wallet compact 10 of the present invention. The cosmetic wallet compact 10 comprises a card casing or first casing 12 having an interior cavity. At the forward end 14 of the compact 10 is a receiving slot 16 through which cards, such as credit cards, identification cards, business cards and the like, are inserted into the interior of the first casing 12. For example, when a credit card C1 is inserted into an empty first casing 12, it passes through the receiving slot 16 into the interior of the first casing 12. As credit card C1 is completely inserted into the interior of the first casing 12, it becomes visible through a dual function window 18, as shown in FIG. 1 and FIG. 2.

Figure 4:
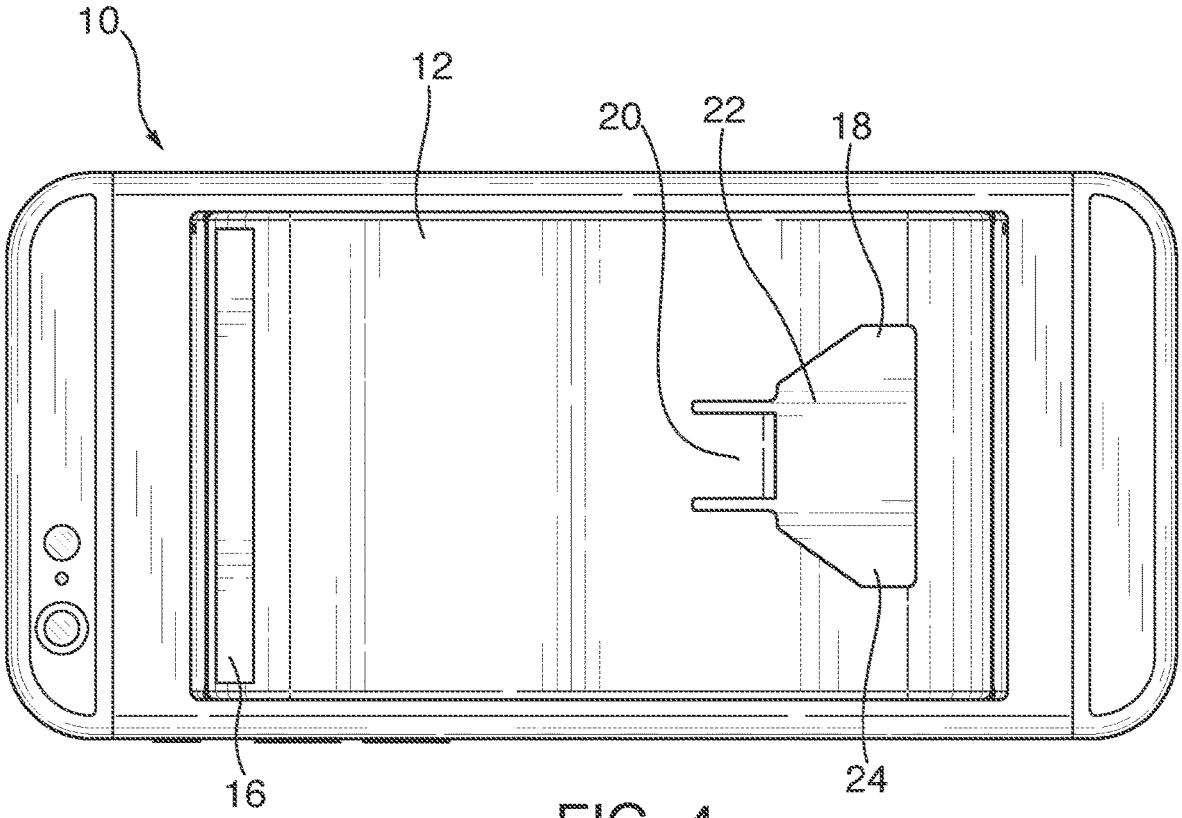
FIG. 4 is a top plan view of the cosmetic wallet compact in a closed position attached to the back surface of a handheld device.

Window 18 defines a retaining press 20 that is resilient and biased against the surface of credit card C1, when inserted. Retaining press 20 is formed as a cutout from the top surface 23 of the first casing 12 and slopes downward into the interior of the first casing 12 so that it is not flush with top surface 23. As such, retaining press 20 comprises a thickness dimension that tapers as retaining press 20 extends from its source, where the cutout from the top surface 23 commences, towards the head or tip thereof. As additional cards, such as identification card C2, are inserted into the interior of the first casing 12, retaining press 20 gently flexes, but maintains sufficient force against the surface of card C1 exposed through the window to prevent card C1, as well as the other cards or bills below, from unintentionally slipping out of receiving slot 16. When first casing 12 is empty, as is shown in FIG. 4, retaining press 20 preferably does not contact or apply any downward pressure or force against the floor 22 of the interior of the first casing 12. However, it should be appreciated and understood that the retaining press can be modified and constructed so that it makes contact with floor 22 of the interior of the first casing 12 to apply pressure or force against the floor 22 of the interior of the first casing 12, if desired.

Window 18 further defines an ejection guide aperture 24 that is sized and adapted to accommodate a finger of a user. Through the ejection guide aperture 24, a user may selectively guide and push card C1 from the first casing 12 by gently directing a card forward through and out of receiving slot 16. Ejection guide aperture 24 preferably takes on a triangular or trapezoidal configuration incorporated into the top surface 23 of first casing 12. However, it should be appreciated and understood that other sizes and shapes may be utilized instead while keeping within the spirit and scope of the invention. In addition, although receiving slot 16 is shown at the forward end 14 of the cosmetic wallet compact 10, it should be appreciated and understood that a receiving slot may be placed at the rear end 15 of the cosmetic wallet compact 10 in addition to, or instead of, receiving slot 16.

First casing 12, and more specifically the interior cavity thereof, is adapted and sized to accommodate a plurality of cards. In a most preferred embodiment, first casing 12 of the cosmetic wallet compact 10 is adapted and sized to accommodate a combination of at least two to four credit card(s), identification card(s), and one or more folded paper bills. Thus, since the dimensions of a standard credit card are 3.370 inches in length by 2.125 inches in width by 0.0300 inches in height (or thickness), the interior of the first casing should be sized to accommodate at least two to four of such cards. It should also be appreciated that if additional space is needed, the interior cavity can be made larger by increasing the thickness or height of the lid as desired. It should also be appreciated that alternate embodiments can be created to accommodate other small personal effects such as mints, toothpicks, medication, condoms, key(s) etc. without departing from the spirit and scope of the present invention. Likewise, an alternate preferred embodiment of the cosmetic wallet compact may come with these (i.e., mints, toothpicks, condoms, floss) and other daily items.

Figure 7:
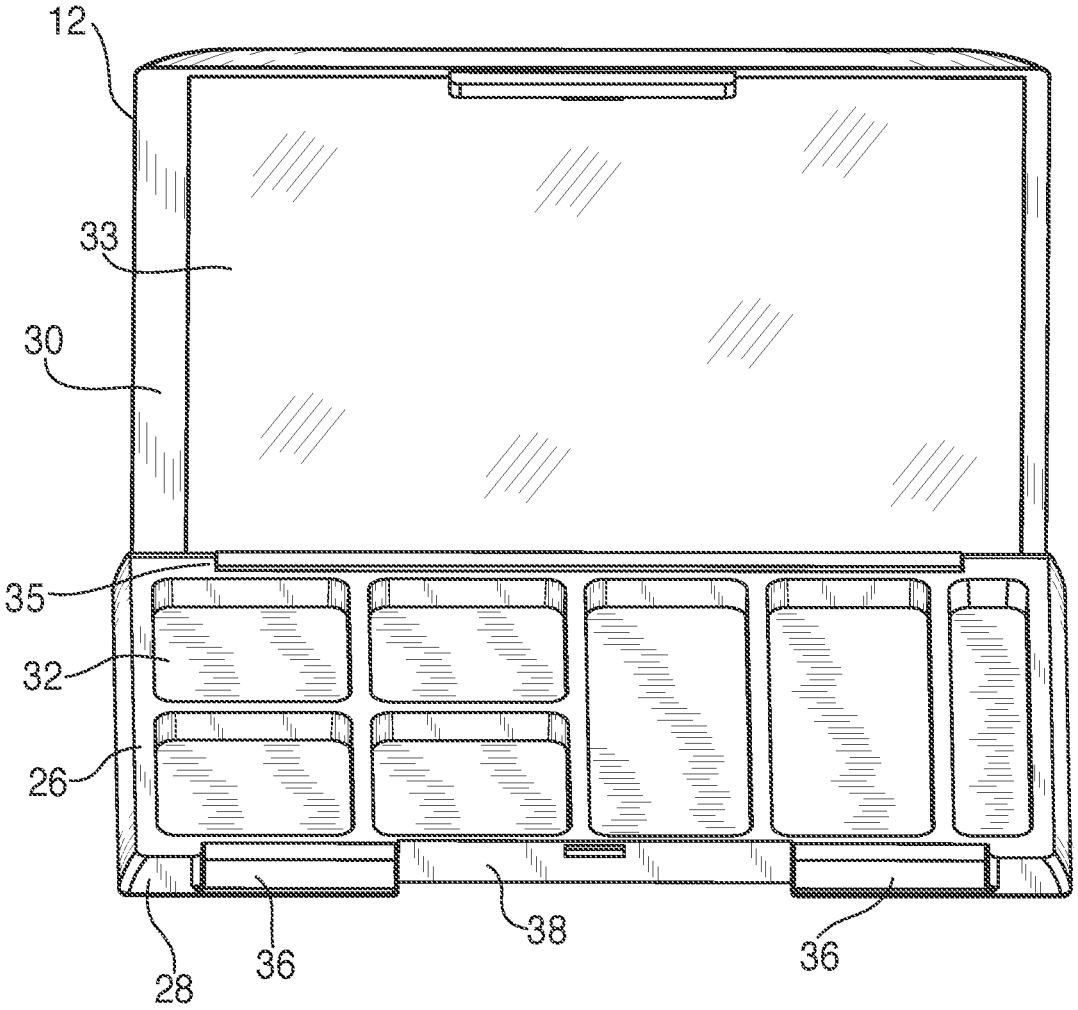
FIG. 7 depicts the mirror and palette of the interior of the cosmetic wallet compact of the present invention.

Cosmetic wallet compact 10 further comprises an interior cosmetic casing or second casing 26 having an interior cavity as shown in FIG. 7. In a most preferred embodiment, the palette 32 comes pre-filled with an array of colored makeup (e.g., eye shadow, blush, foundation, concealer bronzer, lip gloss etc.) and applicator(s), relieving a user of filling the palette 32. The interior of second casing 26 is defined, in part, by a base 28 that rests against and is fastened to a handheld device, as shown most clearly in FIG. 2 and FIG. 3. The interior of the second casing 26 is further defined by the first casing 12, which serves as a lid or cover 30 for the palette of color cosmetics 32, as shown in FIG. 7. In a preferred embodiment four small wells are provided in a two by two configuration, adjacent to two larger wells and a brush well. It should be appreciated and understood that other configurations are available, as desired.

Figure 3:
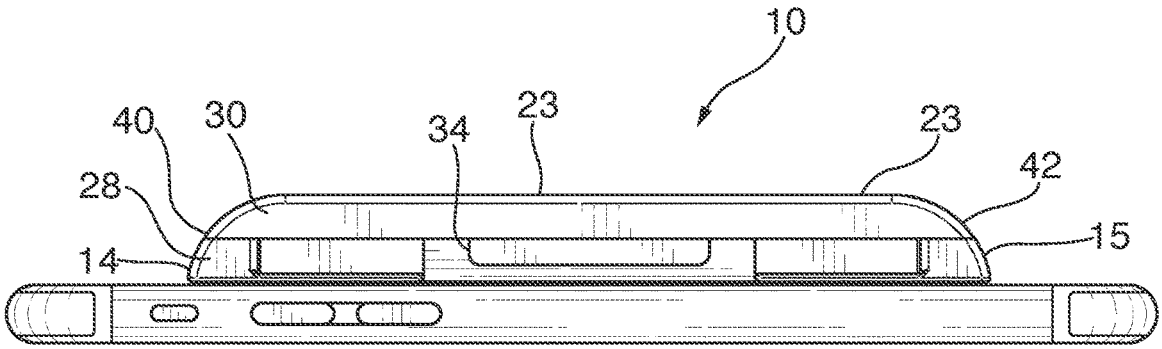
FIG. 3 is a left side elevational view of the cosmetic wallet compact in a closed position attached to the back surface of a handheld device.

As shown in FIG. 2 and FIG. 3, the profile of the cosmetic wallet compact 10 is designed to add minimal bulk to the thickness of a handheld device to which it is attached. In a preferred embodiment, the length dimension of the compact 10 is approximately 96.8 mm; the width dimension is 58.0 mm and the thickness or height dimension is 10.5 mm. Preferably, the mirrored surface applied interior of the second casing is 80.0 mm by 40.0 mm.

Significantly, the profile of the wallet compact 10 incorporates smooth curved surfaces 40, 42 at the forward end 14 and at rear end 15 of wallet compact 10. In addition to providing aesthetic appeal, these smooth curved surfaces 40, 42 enable a user to easily slide the compact 10 and handheld device into a pocket without inadvertently separating the compact 10 from the handheld device. Notably, as shown most clearly in FIG. 3 curved surfaces 40, 42 form a continuous contour from the top surface 23 until the bottom surface 25 of base 28. In an alternate embodiment, sharper contours or slopes may be provided (e.g., 25 to 50 degrees) if desired to further assist in the process of tucking the compact into a pocket while attached to a handheld device.

Figure 6:
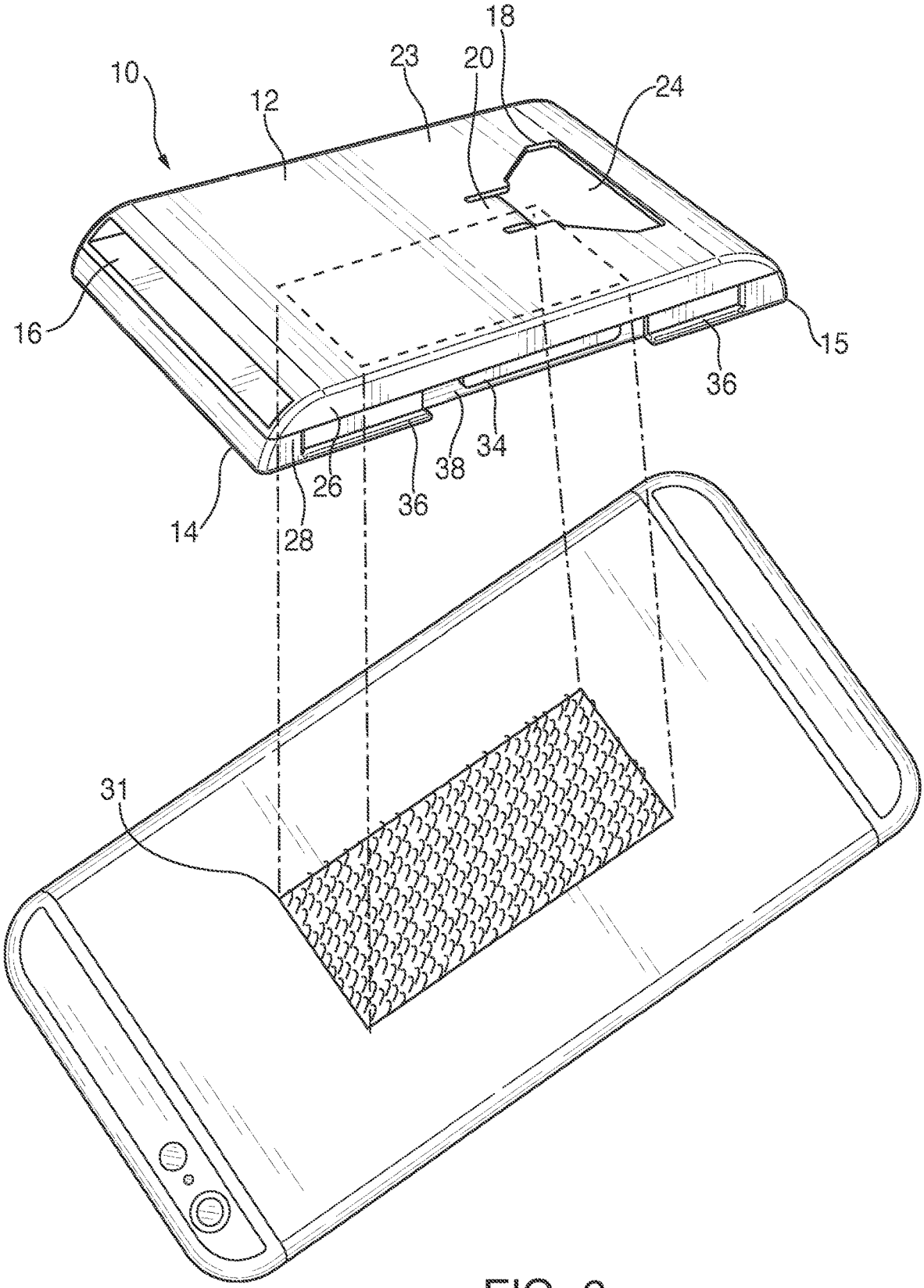
FIG. 6 depicts the cosmetic wallet compact aligned to attach to the back surface of a handheld device via a hook and look fastener strips.

As shown in FIG. 6, cosmetic wallet compact 10 is fastened to a smartphone or other handheld device via strips of mating hook and loop fasteners 31, as shown in FIG. 6, or other fixation means. Fixation means provides the ability to selectively attach and remove cosmetic wallet compact 10 from a smartphone or other handheld device. It should be appreciated and understood that a user may secure cosmetic wallet compact 10 to a protective skin or case covering the handheld device (instead of directly to the back of the handheld device) while still keeping within the spirit and scope of the invention. It should also be appreciated and understood that a user may carry cosmetic wallet compact 10 separately from a handheld device. Moreover, it should also be appreciated and understood that a user may attach cosmetic wallet compact 10 to other devices, such as tablets or laptops or other technological implements without departing from the spirit and scope of the present invention.

In a preferred embodiment, a single set of mating strips of hook and loop fasteners, measuring approximately 60 mm×19 mm, and positioned in the center of cosmetic wallet compact 10 is sufficient. In an alternate preferred embodiment, two sets of mating strips of hook and loop fasteners are positioned at the forward end 14 and rear end 15, at the bottom surface 25 of base 28 and transverse to ledge cutouts 36, 36 and hinge 35. In this configuration, additional total surface area is provided to provide a better connection between the base 28 and handheld device.

In other alternate preferred embodiments, microsuction tape or strong hold adhesive tape, such as those marketed by 3M, may be utilized to secure the base of improved compact to a smartphone. Yet another alternative fixation means comprises a magnet that is placed on the base of the device which enables the entire improved compact to "stick" to a set of corresponding magnets that are attached by a user to a smartphone.

Figure 5:
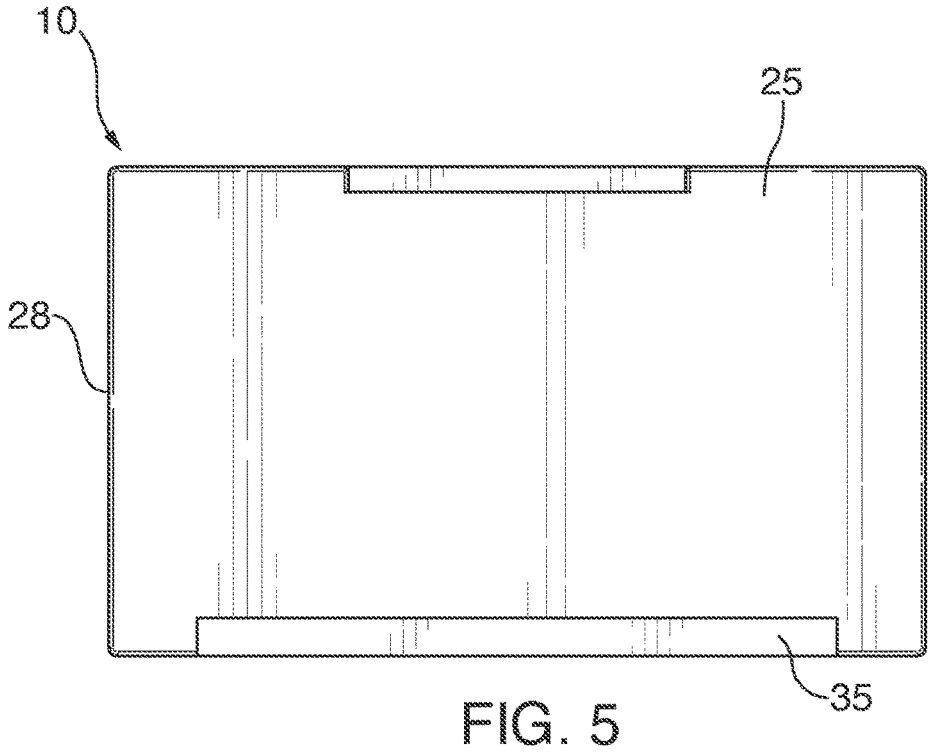
FIG. 5 is a bottom plan view of the cosmetic wallet compact in a closed position, without strips of hook and loop fasteners on the surface thereof.

Base 28 and cover 30 are hingedly attached to one another, as at hinge 35, as shown in FIG. 5, and fastened closed via a conventional snap latch or clip fastener 34 as shown in FIG. 2 and FIG. 3. It should be appreciated and understood that a snap latch or clip fastener may be provided at other sides of the cosmetic wallet compact to hold the cover or lid in place and prevent it from swinging open. It should also be appreciated and understood that other means to attach the cover to the base which are known to those of ordinary skill in the art may be used in place of a conventional hinge and latch. For example, a snap fastener or a hook and loop fastener may be utilized in place of a latch shown in the drawings.

To assist in the opening of cover 30 to access palette 32, two ledge cutouts 36, 36 are provided on either side of fastener 34 which a user may hold and anchor to help separate and pivot cover 30 open and away from base 28. Base 28 is further recessed forming a gap 38 between ledge cutouts 36, 36, further assisting in the opening of cover 30.

As shown in FIG. 7, on the opposite side of cover 30, in the interior cavity of the second casing 26 is mirror panel 33. In a preferred embodiment, mirror panel 33 comprises a paper-thin mirrored surface, such as a mirrored foil, which is preferably utilized to reduce the overall thickness and weight of cosmetic wallet compact 10. The mirrored surface panel 33 is applied to the interior of the cover 30 with adhesive. It should be appreciated and understood that actual mirrored glass may be utilized instead of mirrored foil. With this configuration of cosmetic wallet compact 10, the second casing 26 shares a wall with the first casing 12. Specifically, the wall backing the mirrored surface panel 33 forms floor 22 in the interior cavity of the first casing 12.

In an alternate embodiment, the cosmetic wallet compact incorporates a selectively removable cosmetic tray, instead of the permanent tray depictured in FIG. 7. In either configuration, removable or non-removable, a plurality of small makeup wells, a one or more large wells and an elongated brush well with cosmetic brush are provided to apply makeup. Alternate configurations with only small makeup wells (e.g. with 6-10 wells) and a brush are available as well. In alternate configurations having a removable tray, the tray is placed in a receptacle cavity in the base of the improved compact. In such an alternate preferred embodiment, the cosmetic tray is disposable and intended to be replaceable by other trays, as desired. Optionally, the cosmetic tray can be filled and refilled by a user with her own desired cosmetics. Alternatively, the cosmetic tray can be constructed in pre-filled configurations and placed into the wallet compact.

The accompanying drawings only illustrate a preferred embodiments of a cosmetic wallet compact. However, other types and configurations are possible, and the drawings are not intended to be limiting in that regard. Thus, although the description above and accompanying drawings contains much specificity, the details provided should not be construed as limiting the scope of the embodiment(s) but merely as providing illustrations of some of the presently preferred embodiment(s). The drawings and the description are not to be taken as restrictive on the scope of the embodiment(s) and are understood as broad and general teachings in accordance with the present invention. While the present embodiment(s) of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention. It should also be noted that the terms "first," "preceding," "second," "subsequent" and similar terms may be used herein to modify various elements. These modifiers do not imply a spatial, sequential, or hierarchical order to the modified elements unless specifically stated. Indeed, it should be appreciated, for example, that the terms "first" and "second" may be interchangeable such that the items to which they refer incorporate features of the other, where appropriate.

The invention claimed is:

1. A cosmetic wallet compact comprising:

a first casing having a first forward end, a first rear end, a top surface and a first interior cavity, said first casing adapted and sized to hold and retain cards in said first interior cavity;

a receiving slot positioned at said first forward end of said first casing;

a retaining press at said top surface of said first casing to prevent cards from unintentionally exiting said receiving slot;

an ejection guide aperture defining a portion of and contiguous with said retaining press, and sufficiently sized to receive a user's finger at said top surface of said first casing through which contents in said first casing are visible;

a second casing having a second interior cavity, and a base with a flat bottom surface, a second forward end and a second rear end;

a palette of color cosmetics located in said second interior cavity; and a mirror panel located in said second interior cavity;

said first casing forms a cover on said second casing;

wherein said first casing and said second casing are hingedly attached to one another; and wherein said first forward end of said first casing and said second forward end of said base together form a continuous smooth curved arch surface, the curve of which continues until the bottom surface of said base, and said first rear end of said first casing and said second rear end of said base together form a continuous smooth curved arch surface, the curve of which continues until the bottom of said base.

2. The cosmetic wallet compact of claim 1, further comprising a recessed gap at said base, two ledge cutouts at said base and a clip fastener;

wherein said first casing selectively forms a cover that covers said palette of color cosmetics, and said recessed gap and clip fastener are positioned between said two ledge cutouts, said recessed gap and said two ledge cutouts adapted to assist in the opening of said cover; and further wherein said recessed gap is indented more than each of said ledge cutouts at said base and has a length that is larger than each of said ledge cutouts at said base.

3. A cosmetic wallet compact comprising:

a housing having an exterior surface with a first forward end and a first rear end, a first casing with a first interior cavity and a second casing with a second interior cavity, said first casing and said second casing sharing a common wall with one another;

a receiving slot positioned at an opening of said first casing;

a retaining press cutout in said first casing;

an ejection guide aperture defining a portion of and contiguous with said retaining press, and sufficiently sized to receive a user's finger in said first casing;

a tray with color cosmetics located in said second interior cavity of said second casing; and a mirror panel located in said second interior cavity of said second casing;

a base having an exterior surface with a second forward end and a second rear end;

a recessed gap at said base, two ledge cutouts at said base and a clip fastener;

wherein said first casing covers said second interior cavity; and wherein said first casing forms a cover that selectively covers said tray with color cosmetics, and said recessed gap and clip fastener are positioned between said two ledge cutouts, said recessed gap and said two ledge cutouts adapted to assist in the opening of said cover; and further wherein said recessed gap is indented more than each of said ledge cutouts at said base and has a length that is larger than each of said ledge cutouts at said base.

4. The cosmetic wallet compact of claim 3, wherein said first forward end of said housing and said second forward end of said base together form a continuous smooth curved arch surface, the curve of which begins at a top surface of said exterior surface of said housing and continues until the bottom surface of said base, and said first rear end of said housing and said second rear end of said base together form a continuous smooth curved arch surface, the curve of which begins at said top surface of said exterior surface of said housing and continues until the bottom of said base to facilitate sliding of said housing into a pocket.

5. The cosmetic wallet compact of claim 4, wherein said first casing and said second casing are hingedly attached to one another and selectively secured closed with said clip fastener.

6. A cosmetic wallet compact comprising:

a housing having a top surface formed by a first casing with a first interior cavity, and a bottom surface and base formed by a second casing with a second interior cavity, said first casing and said second casing sharing a common wall with one another;

a receiving slot positioned at an opening of said first casing;

a retaining press cutout in said first casing;

an ejection guide aperture defining a portion of and contiguous with said retaining press, and sufficiently sized to receive a user's finger in said first casing;

a tray adapted to accommodate color cosmetics located in said second interior cavity of said second casing;

a mirror panel located in said second interior cavity of said second casing;

at least one ledge cutout at said base;

a clip fastener to fasten closed said first casing to said second casing;

wherein said housing incorporates smooth curved surfaces at a forward end and a rear end of said housing, the curves of said smooth curved surfaces at said forward end and at said rear end of said housing each extends to the bottom surface of said base to facilitate sliding of said housing into a pocket.

7. The cosmetic wallet compact of claim 6, wherein said first interior cavity being sized to adapt at least two standard sized credit cards having 3.370 inches in length, 2.125 inches in width and 0.0300 inches in height.

8. The cosmetic wallet compact of claim 6, further comprising cosmetics in said tray.

9. The cosmetic wallet compact of claim 6, wherein said second interior cavity of said second casing being defined by said first casing as a cover for said tray.

10. The cosmetic wallet compact of claim 6, further comprising a recessed gap at said base, two ledge cutouts at said base and a clip fastener;

wherein said first casing forms a cover that selectively covers said tray, and said recessed gap and clip fastener are positioned between said two ledge cutouts, said recessed gap and said two ledge cutouts adapted to assist in the opening of said cover; and further wherein said recessed gap is indented more than each of said ledge cutouts at said base and has a length that is larger than each of said ledge cutouts at said base.

* * * * *